US006926153B2

(12) United States Patent
Chandaria

(10) Patent No.: US 6,926,153 B2
(45) Date of Patent: Aug. 9, 2005

(54) SHIPPING BOX FOR RETAIL PRODUCTS AND METHOD OF ASSEMBLING SAME

(76) Inventor: Ashok V. Chandaria, P.O. Box 48020, Nairobi (KE)

( * ) Notice: Subject to any disclaimer, the term of this patent is extended or adjusted under 35 U.S.C. 154(b) by 134 days.

(21) Appl. No.: 10/389,331

(22) Filed: Mar. 13, 2003

(65) Prior Publication Data

US 2004/0178110 A1 Sep. 16, 2004

(51) Int. Cl.[7] ..... B65D 75/00

(52) U.S. Cl. ..... 206/784; 206/526; 229/117.12; 229/120.08

(58) Field of Search ..... 206/144, 163, 206/165, 193, 427, 525, 525.1, 526, 784; 229/117.12, 120.08, 120.13, 120.18, 120.24, 120.33

(56) References Cited

U.S. PATENT DOCUMENTS 2,284,815 A * 6/1942 Grimm ..... 229/120.08
2,330,345 A * 9/1943 Elliott ..... 229/120.08
3,025,630 A * 3/1962 Silvey ..... 229/120.08
3,343,665 A * 9/1967 Marino ..... 229/120.08
3,677,458 A * 7/1972 Gosling ..... 206/427
3,744,703 A * 7/1973 Mortenson ..... 229/120.08
4,256,223 A * 3/1981 Pawlowski ..... 229/120.08
4,294,397 A * 10/1981 Kohler ..... 229/120.08

* cited by examiner

*Primary Examiner*—Luan K. Bui
(74) *Attorney, Agent, or Firm*—Sand & Sebolt

(57) ABSTRACT

A shipping box includes a bottom wall, a pair of opposing side walls extending from the bottom wall, a pair of top wall portions each extending from one of the side walls, a pair of top inserts each extending from one of the top wall portions, a pair of opposing end walls extending from the bottom wall, and a pair of end inserts each extending from one of the end walls. Preformed fold lines facilitate folding the side walls, the end walls, top wall portions and inserts to form a pair of interior storage chambers therebetween for containing a display board with retail product attached thereto. The box folds around the board and product with a snug fit being provided between the box and board. The top inserts fold into the box, contacting the board. Slots in the end inserts mesh with slots formed partially in the top wall portions and partially in the top inserts. Slits in the top wall portions define U-shaped handles.

30 Claims, 11 Drawing Sheets

SHIPPING BOX FOR RETAIL PRODUCTS AND METHOD OF ASSEMBLING SAME

BACKGROUND OF THE INVENTION

1. Technical Field

The invention relates generally to shipping boxes. More particularly, the invention relates to shipping boxes for retail products, the boxes being flat in an unfolded configuration and having preformed fold lines for folding the box around a display board and a retail product attached thereto. Specifically, the invention relates to shipping boxes for retail products wherein the box has specific dimensions so that a display board fits snugly into the box when the box is folded around the product and board.

2. Background Information

Various types of boxes exist wherein a flat material such as cardboard, is configured to efficiently fold into the final box shape. However, the need exists for a such a shipping box for retail products with a simple configuration so that (1) the box is configured to contain a product attached to a display board; (2) the box is dimensioned to snugly fit the display board and thus prevent or reduce movement of the display board and product within the box during handling and shipping; (3) the product and display board can be placed on the unfolded box and the box quickly folded around the product and display board; (4) the box has top inserts which when folded into the box interior provide structural strength, help hold the display board in place and space the top of the box from the retail product inside; (5) the box eliminates the need for packing material through the combination of the product being attached to the display board, the display board fitting snugly in the box and the top inserts holding the display board in place and spacing the product from the top of the box; (6) the box has meshing slots formed therein which help prevent the box from inadvertently opening during handling and shipping without the use of tape or other fasteners; (7) the box is formed with pop-up handles that can be used to easily place the shipping box into and remove it from a larger shipping container made to receive the size of the shipping box, said handles allowing the box to be lowered without holding the box on the sides or bottom, thus keeping the handler's hand and fingers from contact from the shipping container and preventing related possible injury; and (8) the box can be easily opened and the display board and attached product removed in a condition ready to display for retail purposes.

Prior art includes preformed boxes and unfolded boxes having fold lines which define the dimensions of the box. However, such boxes are not intended to be used with a display board having a product attached thereto and do not fold around such a board and product. Neither do these prior art boxes have dimensions that snugly hold the display board, nor top inserts that provide structural strength, nor help hold the display board in place and space the top of the box from the product. Further, they do not eliminate the need for packing material through the combination of the product being attached to the display board, the display board fitting snugly in the box and the top inserts holding the display board in place and spacing the product from the top of the box. These prior art boxes do not have meshing slots which help prevent the box from inadvertently opening during handling and shipping without the use of tape or other fasteners, nor do they have slits defining cutouts and pop-up handles. Likewise, these boxes do not have such handles that allow the box to be lowered without holding the box on the sides or bottom. Nor are they configured to easily open to remove a display board and attached product in a condition ready to display for retail purposes.

BRIEF SUMMARY OF THE INVENTION

Advantages of the invention include a shipping box specifically configured to contain retail product which is attached to a display board.

Another advantage of the invention is a box with inner dimensions that fit snugly around the edges of the display board to prevent shifting of the board and product within the box during handling and shipping.

A further advantage are top inserts which are inserted into the box in between rows of retail products attached to the display board, and which provide structural strength, help hold the display board in place, space the product from the top of the box and prevent damage to the product.

Another feature is a box that eliminates the need for packing material through the combination of the product being attached to the display board, the display board fitting snugly in the box and the top inserts holding the display board in place and spacing the product from the top of the box.

Another advantage of the invention is a shipping box which can be quickly folded around the product and display board to facilitate preparation for shipping.

Another feature of the invention is providing pop-up handles extending above the top of the box, the handles allowing a handler to maneuver the box without holding the sides or bottom of the box, and thus being particularly useful for lowering the shipping box, without injury to the hands, into and removing it from a larger shipping container made to receive a number of the shipping boxes.

A further feature are handles formed so that the upward force of lifting the box is exerted on the sides of the box and not on the top so as to help prevent the top of the box from opening inadvertently.

Another advantage is providing the box with slots formed in the top wall portions and the end inserts which mesh with one another to help prevent the box from inadvertently opening during handling and shipping without the use of tape or other fasteners.

Another advantage is providing a box which is easily opened, with the display board and attached product removed in a condition ready to display for retail purposes.

A further advantage is providing the box with preformed fold lines to facilitate folding the box around the display board and product.

These and other advantages and features of the invention are obtained by the improved shipping box, the general nature of which may be stated as including a bottom wall; a pair of opposing side walls joined to the bottom wall; a pair of top wall portions each joined to one side wall; a pair of top inserts each joined to one top wall portion; a pair of opposing end walls joined to the bottom wall; a pair of end inserts each joined to one end wall; the walls, top wall portions and inserts when folded inwardly forming a pair of interior storage chambers therebetween for containing a display board with retail product attached thereto.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
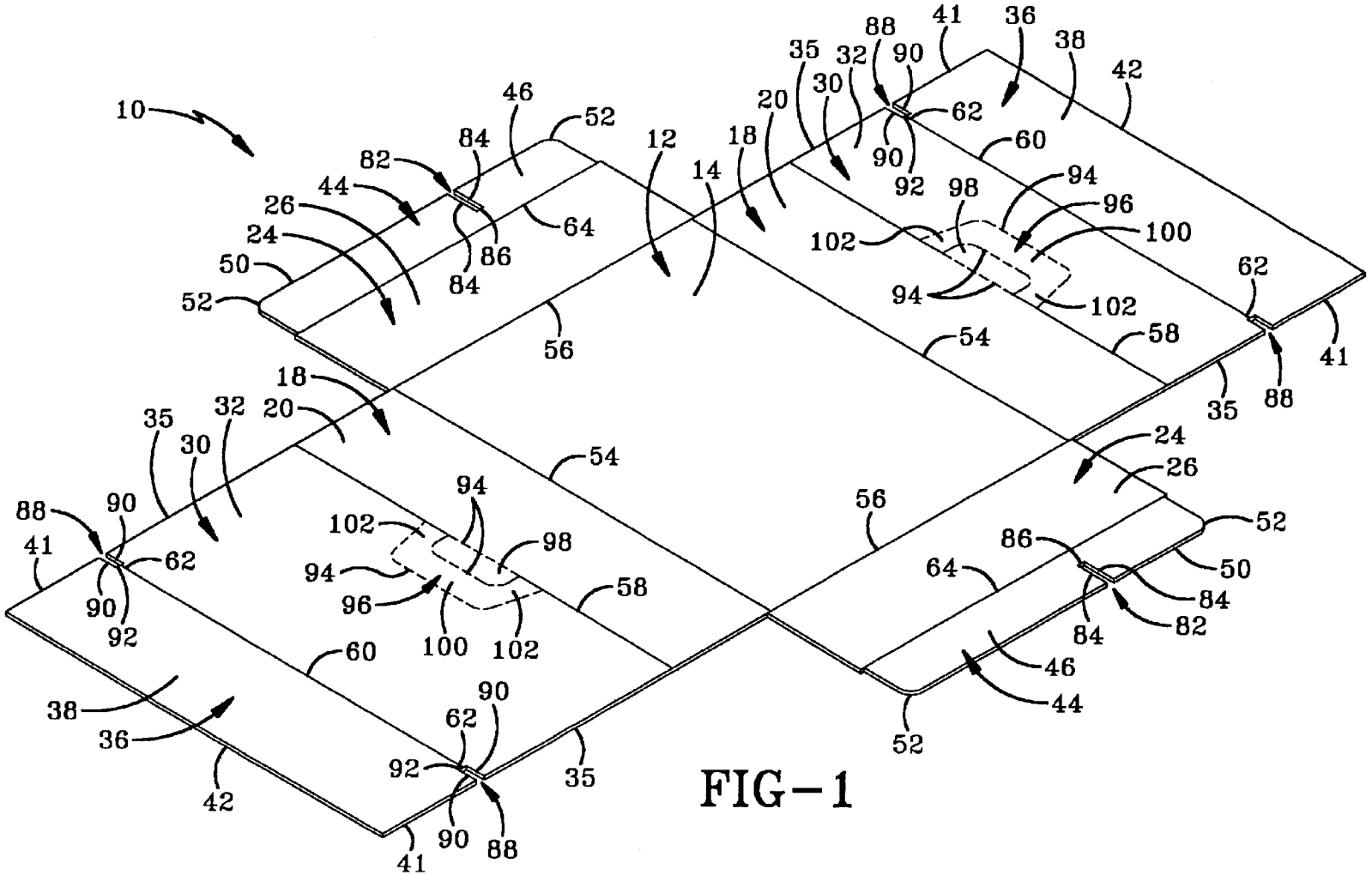
FIG. 1 is a perspective view of the shipping box of the present invention in an unfolded position.

The improved shipping box of the present invention is indicated generally at 10, and is shown in FIGS. 1–13. Box 10 is shown in an unfolded configuration in FIGS. 1 and 2, and in a folded configuration in FIG. 7. As a preliminary note to facilitate comprehension of the description, directional terms such as inner, outer, upper and lower are generally used in reference to box 10 in the folded position.

Shipping box 10 includes a substantially flat, rectangular bottom wall 12 having an inner surface 14 and an outer surface 16; two substantially flat, rectangular side walls 18, each having an inner surface 20 and an outer surface 22; two end walls 24 having an inner surface 26 and an outer surface 28; two substantially flat, rectangular top wall portions 30, each having an inner surface 32, an outer surface 34 and edges 35; two substantially flat, rectangular top inserts 36, each having an inner surface 38, an outer surface 40, side edges 41 and a terminal edge 42; two substantially flat, rectangular end inserts 44, each having an inner surface 46, an outer surface 48, an edge 50 and contoured corners 52. One top wall portion 30 is wider than the other top wall portion 30 as measured from respective side walls 18 to respective top inserts 36, though the widths could be equal under appropriate circumstances as discussed later.

Box 10 also includes various preformed fold lines which are formed in the unfolded box which help define the dimensions of box 10 in the folded configuration. A pair of fold lines 54 are formed where bottom wall 12 intersects with each side wall 18. A pair of fold lines 56 are formed where bottom wall 12 intersects with each end wall 24. A pair of fold lines 58 are formed where each side wall 18 intersects with each top wall portion 30. A pair of fold lines 60 are formed where each top wall portion 30 intersects with each top insert 36, said fold lines 60 having ends 62. A pair of fold lines 64 are formed where each end wall 24 intersects with each end insert 44.

Figure 9:
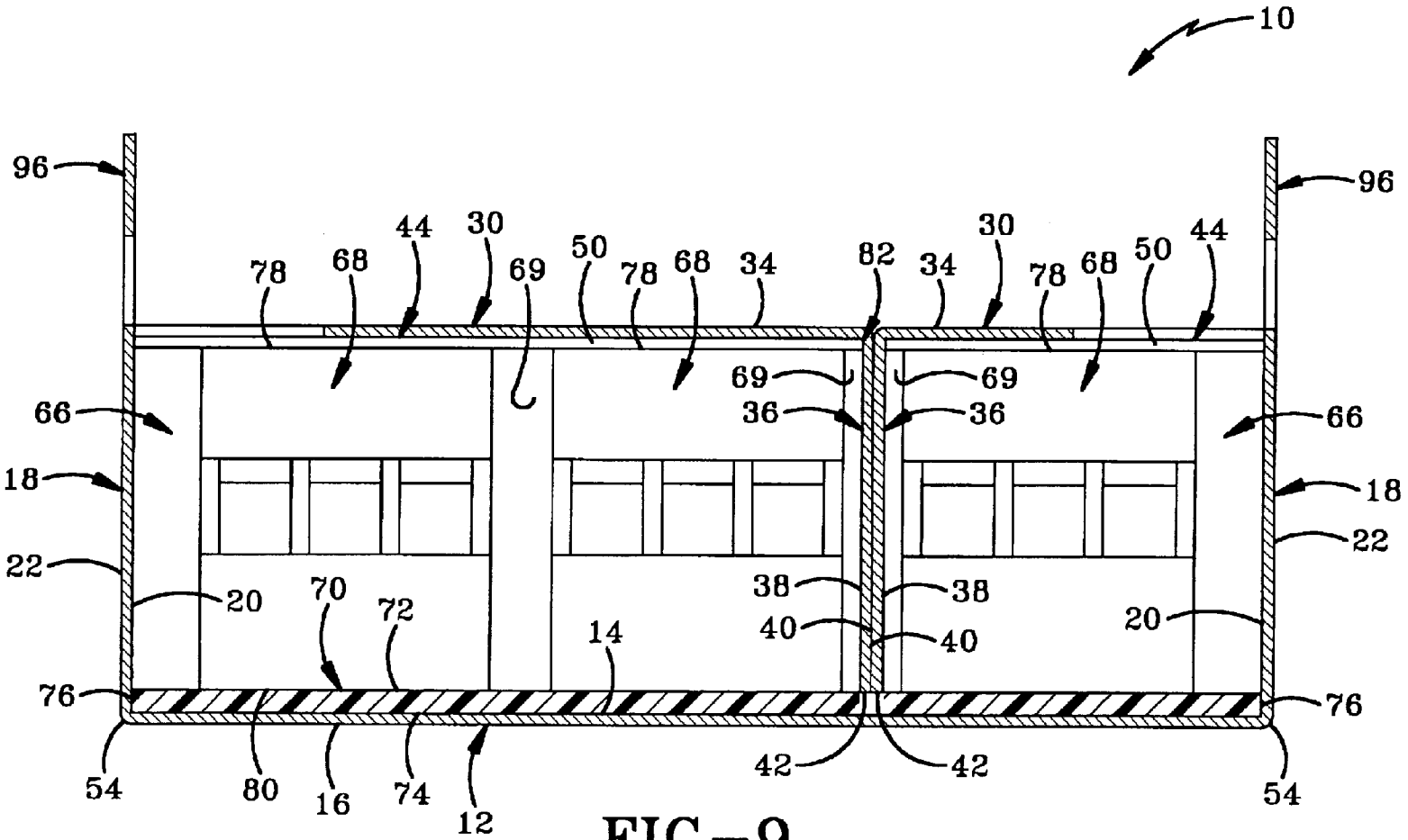
FIG. 9 is an enlarged sectional view of the shipping box taken on line 9—9 of FIG. 8.
Figure 10:
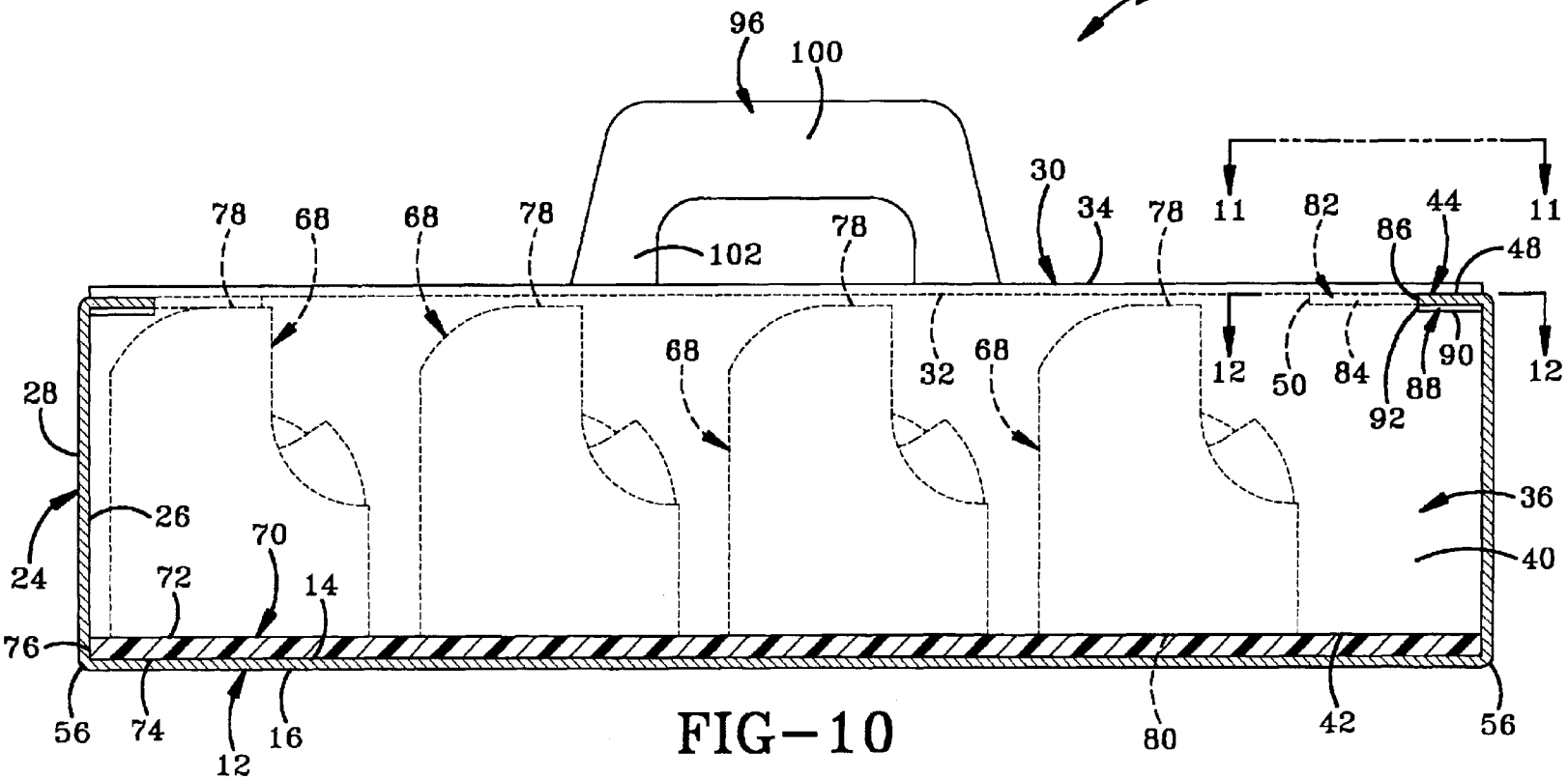
FIG. 10 is an enlarged sectional view of the shipping box taken on line 10—10 of FIG. 8 showing retail product in dot-dash line.

In its unfolded configuration (FIG. 1), box 10 is substantially flat and cross-shaped. Bottom wall 12, side walls 18, end walls 24, top wall portions 30, and inserts 36 and 44 are formed as an integral one-piece member of cardboard or other suitable material, and when folded inwardly into the folded configuration (FIG. 7), form a parallelepiped having a pair of interior storage chambers 66 therebetween for containing retail products 68 removably attached to a display board 70. Retail products 68 are tape dispensers (FIG. 2), although the specific product could encompass a wide variety. Retail products 68 are attached to display board 70 in rows 67 with spaces 69 therebetween. As shown in FIG. 9, storage chambers 66 are separated by top inserts 36, which in the folded configuration are contiguous one another along outer surfaces 40 and extend toward bottom wall 12. Top inserts 36 in the folded configuration extend between rows 67 of retail product 68 along one of the spaces 69. As shown in FIG. 10, outer surfaces 48 of end inserts 44 are adjacent inner surfaces 32 of top wall portions 30 in the folded configuration. Display board 70 includes an upper surface 72, a lower surface 74, edges 76 and a pair of slots 77 formed therein adjacent one of edges 76 for hanging board 70 for retail display. Retail products 68 have upper surfaces 78 and lower surfaces 80 and, when attached to display board 70, extend outwardly from upper surface 72 of display board 70 with lower surface 80 of retail products 68 adjacent upper surface 72 of display board 70. In the folded configuration, terminal edges 42 of top inserts 36 contact upper surface 72 of display board 70. Top inserts 36 are dimensioned so that in the folded configuration, inner surfaces 32 of top wall portions 30 are adjacent to, but not in contact with, upper surfaces 78 of retail products 68, as shown in FIGS. 9 and 10.

A slot 82 (FIG. 1) having elongated parallel edges 84 is formed in each end insert 44 and extends perpendicularly from edge 50 partially across insert 44 and terminates in terminal edge 86 parallel to edge 50 of end insert 44. Slots 82 are opposed, have equal dimensions and are collinear along parallel edges 84.

Figure 12:
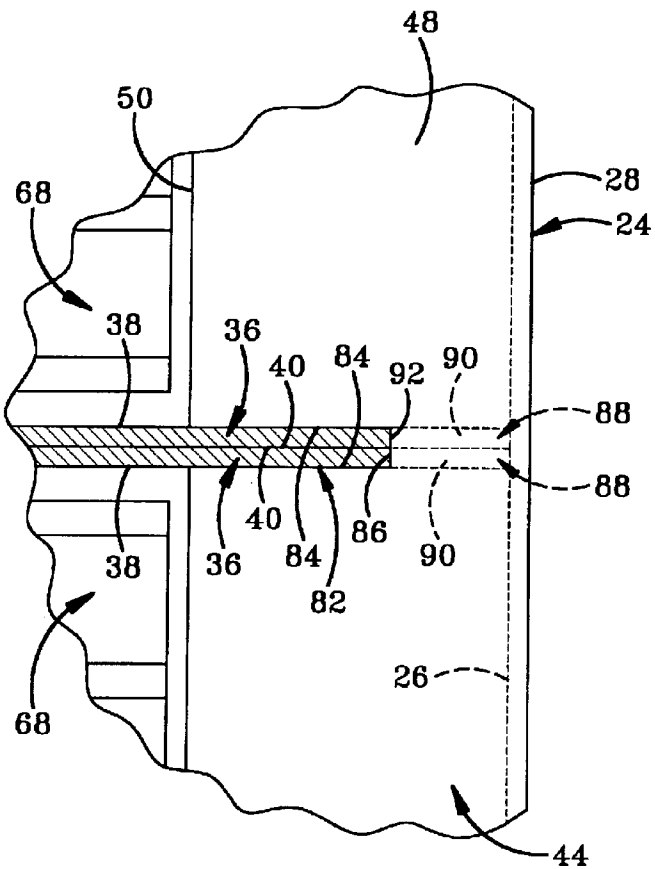
FIG. 12 is an enlarged fragmentary sectional view of the shipping box taken on line 12—12 of FIG. 10.
Figure 11:
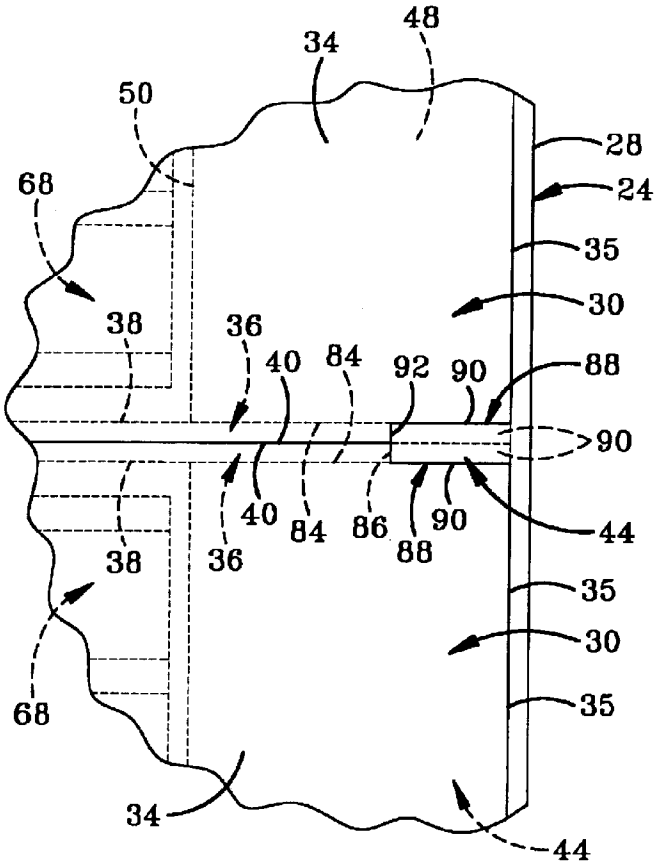
FIG. 11 is an enlarged fragmentary sectional view of the shipping box taken on line 11—11 of FIG. 10.

Four slots 88 are formed in box 10 so that each of the four slots 88 is formed partially in one top wall portion 30 and partially in the adjacent top insert 36. Each slot 88 extends partially across box 10 perpendicularly from the respective edge 35 of top wall portion 30 and side edge 41 of top insert 36. Each slot 88 is of equal dimension and has elongated parallel edges 90 that extend parallel to fold line 60. Each slot 88 terminates in terminal edges 92 at ends 62 of fold lines 60. Terminal edges 62 extend parallel to edges 35 and 41. When box 10 is in a folded configuration (FIG. 7), a first pair of the four slots 88 lies adjacent one another and a second pair of the four slots 88 lie adjacent one another. In the folded configuration, each slot 82 is slidably meshed with one pair of slots 88 which lie adjacent one another (FIGS. 10–12).

A pair of slits 94 are formed in each top wall portion 30 and define U-shaped handles 96 having end portions 100 and lateral portions 102. End portions 100 extend parallel to fold lines 58 between side walls 18 and respective top wall portions 30. Lateral portions 102 extend from end portions 100 and terminate on fold lines 58. One slit 94 of each pair defines substantially rectangular cutouts 98, located adjacent handles 96 and between lateral portions 102.

In the folded configuration of box 10, the dimensions of the rectangle defined by inner surfaces 20 and 26 of side walls 18 and end walls 24 are substantially equal to the dimensions of the rectangle defined by edges 76 of display board 70. In the folded configuration with display board 70 and retail products 68 in storage chamber 66, lower surface 74 of display board 70 is in contact with inner surface 14 of bottom wall 127 and upper surface 78 of retail product 68 is adjacent inner surfaces 32 of top wall portions 30.

Figure 13:
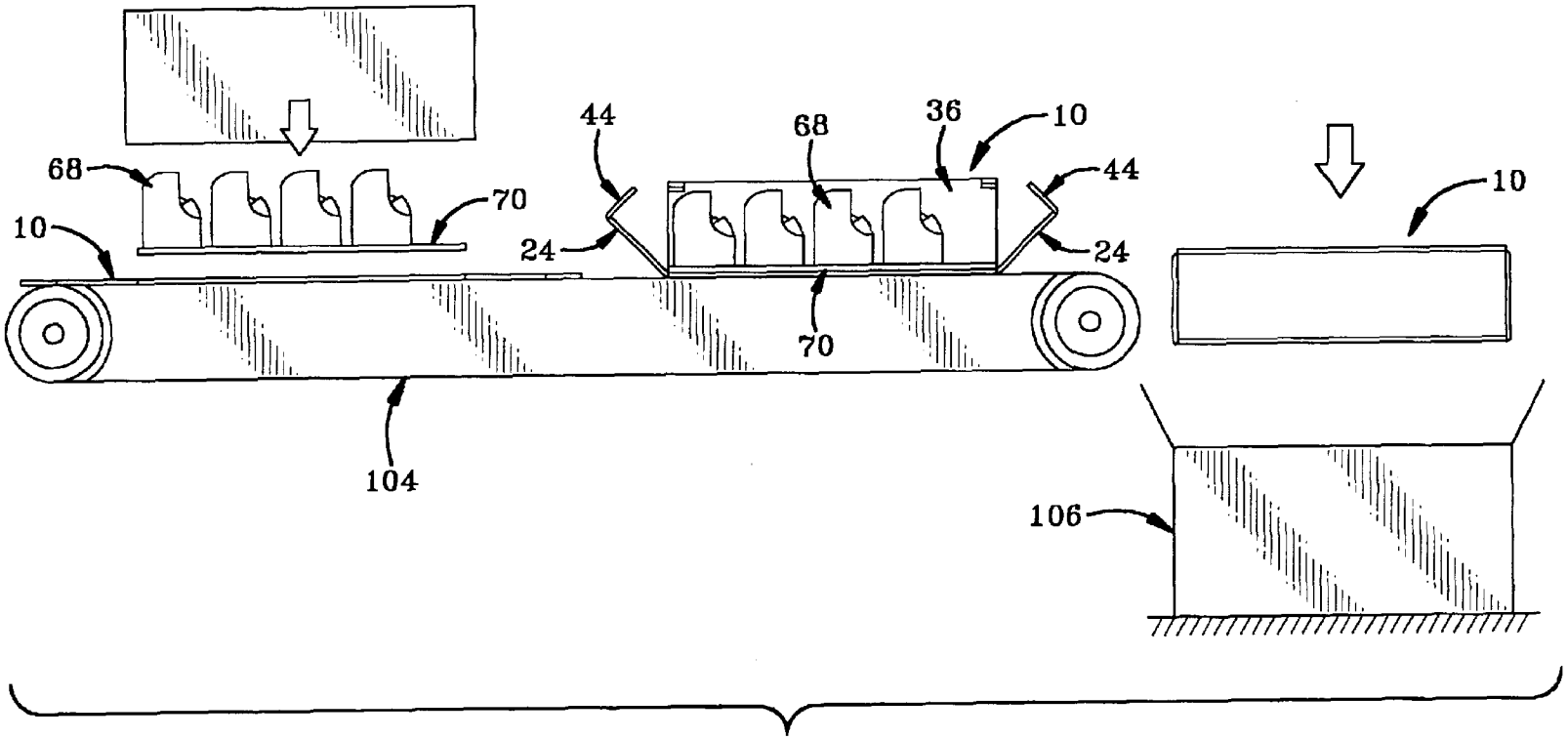
FIG. 13 is a schematic view of the shipping box of the present invention on a conveyor belt in the process of preparing the box with display board and retail product for shipping.

Box 10 is dimensioned to be easily inserted into or removed from a larger shipping container 104 configured to hold a plurality of boxes 10 therein. FIG. 13 shows shipping box 10 in the process of being formed as it moves along a conveyor belt 106 and placed into larger shipping container 104.

In accordance with one of the main features of the present invention, box 10 is configured to be efficiently folded around display board 70 with retail products 68 attached thereto, so that box 10 fits snugly around display board 70 while allowing some protective space between products 68 and the walls of box 10. More specifically, box 10 is dimensioned so that when it is in the folded configuration (FIG. 7), inner surfaces 20 and 26 of side and end walls 18 and 24 are in contact with edges 76 of display board 70; lower surface 74 of display board 70 is in contact with inner surface 14 of bottom wall 12; and upper surfaces 78 of retail products 68 are adjacent inner surfaces 32 of top wall portions 30. Top inserts 36 contact upper surface 72 of display board 70 in the folded configuration, helping to hold display board 70 in place. The dimensions of top inserts 36 maintain a small distance between upper surfaces 78 and inner surfaces 32. Top inserts 36, in conjunction with display board 70, also provide structural strength between bottom wall 12 and top wall portions 30, which helps prevent top wall portions 30 from being pushed inwardly and damaging products 68.

Box 10 eliminates the need for additional packing material to protect the stored product through the combination of products 68 being attached to display board 70, display board 70 fitting snugly in box 10 and top inserts 36 holding display board 70 in place and spacing products 68 from top wall portions 30.

The meshing of slots 82 and 88 provides an interlocking quality which helps keep box 10 from unfolding during handling and shipping without the use of tape or other fasteners, even if lifted by top wall portions 30. This meshing also helps ensure that top inserts 36 do not separate, thus maintaining the snug-fitting contact between side walls 18 and edges 76 of display board 70. Further, this meshing helps keep top wall portions 30 in contact with upper surface 72 of display board 70, which helps keep display board 70 stationary within box 10.

Moreover, this meshing also works in conjunction with the use of U-shaped handles 96, as the interlocking nature of the meshed slots helps a user to lift box 10 by handles 96 without pulling top inserts 36 upwardly out of box 10. Even without the meshing of slots 82 and 88, the attachment of handles 96 along fold lines 58 between side walls 18 and top wall portions 30 prevents the removal of top inserts 36 when box 10 is lifted by handles 96, since the upward force is directed to side walls 18 and not to top wall portions 30 or top inserts 36. Slots 82 also facilitate the insertion of end inserts 44 into box 10 as inserts 44 temporarily accommodate portions of top inserts 36 en route to positioning inserts 44 in their folded configuration.

The differing widths of top wall portions 30 allow top inserts 36 to be inserted to accommodate retail products 68. More specifically, because spaces 69, which are formed between rows 67 of retail products 68, are off center, top wall portions 30 have widths appropriate so that top inserts 36 extend between rows 67 of retail products 68 when inserted in box 10. It will be appreciated that if one space 69 is centered due to different configurations of rows 67 of products 68, top wall portions 30 could be of equal width.

Figure 2:
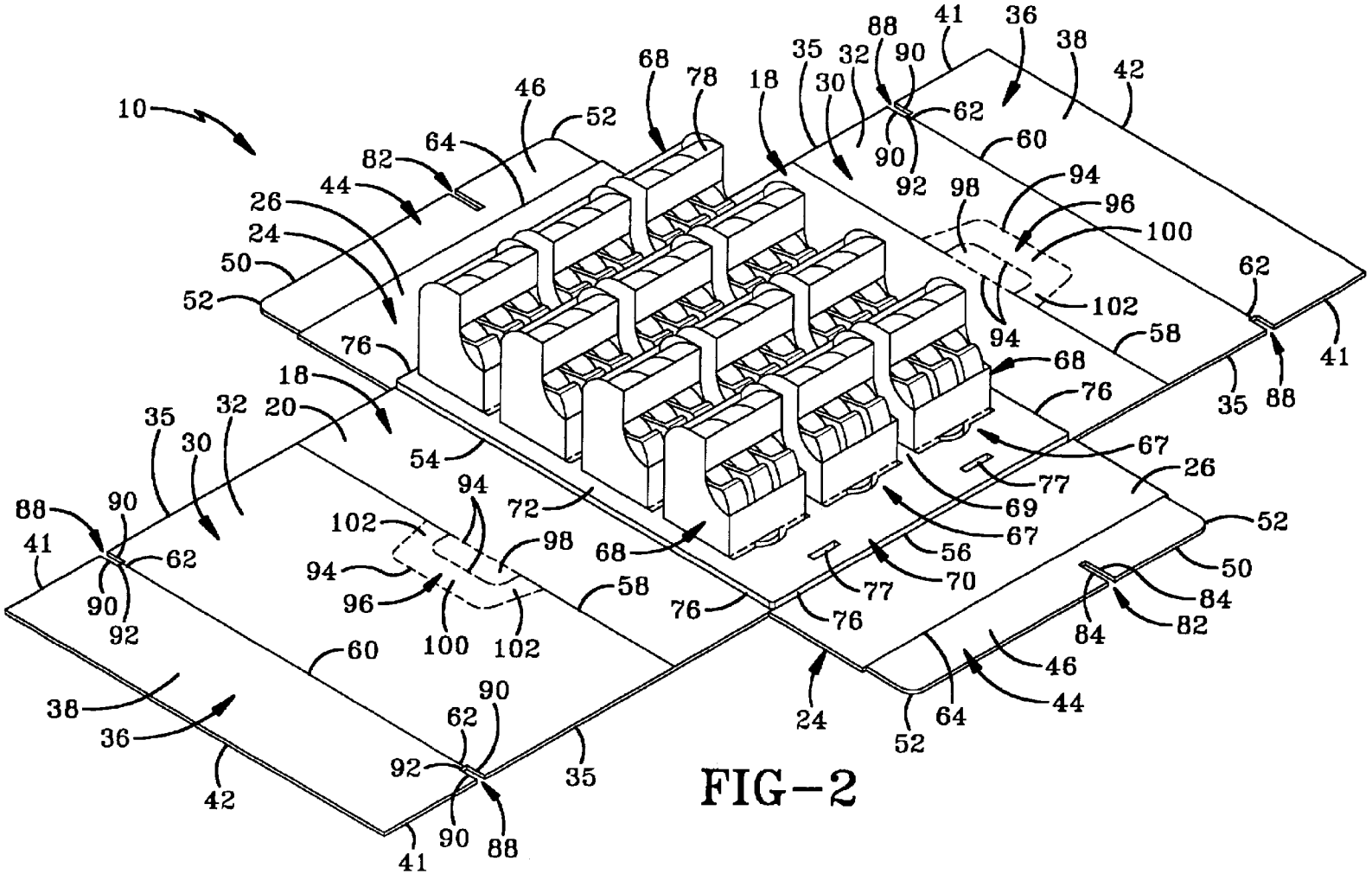
FIG. 2 is a perspective view of the shipping box in an unfolded position with a display board and retail product ready to be stored therein.

FIGS. 1–8 show progressive stages of box 10 being folded around display board 70 and retail products 68. In FIG. 1, box 10 is in the unfolded configuration laying flat on a generally horizontal surface. FIG. 2 shows display board 70 with attached retail products 68 placed on inner surface 14 of bottom wall 12.

Figure 3:
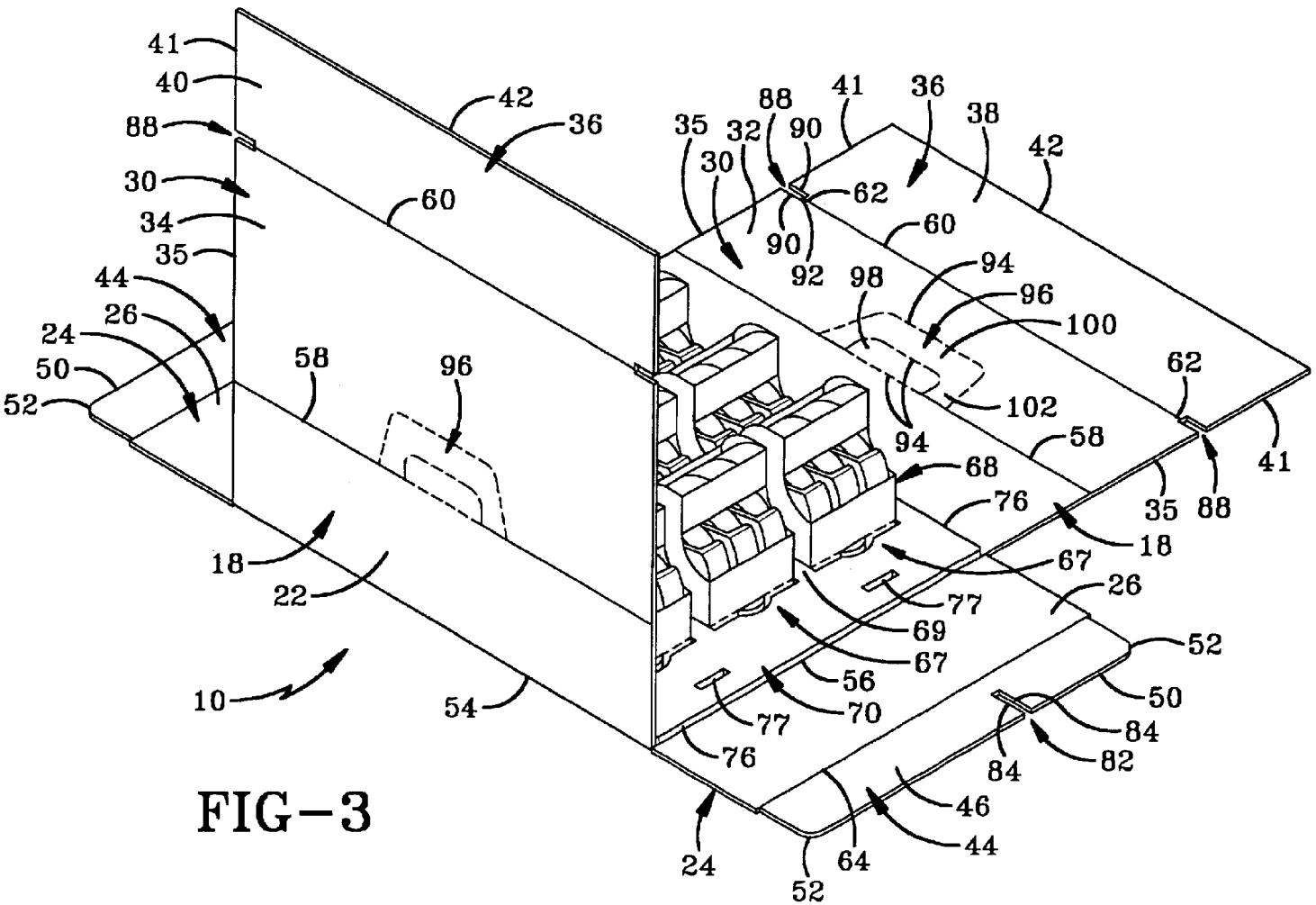
FIG. 3 is a perspective view of the shipping box in a partially folded position about the display board and retail product.

FIG. 3 shows box 10 folded upwardly along one fold line 54 so that one side wall 18, one top wall portion 30 and one top insert 36 are aligned in a generally vertical plane, and inner surface 20 of one side wall 18 contacts one edge 76 of display board 70.

Figure 4:
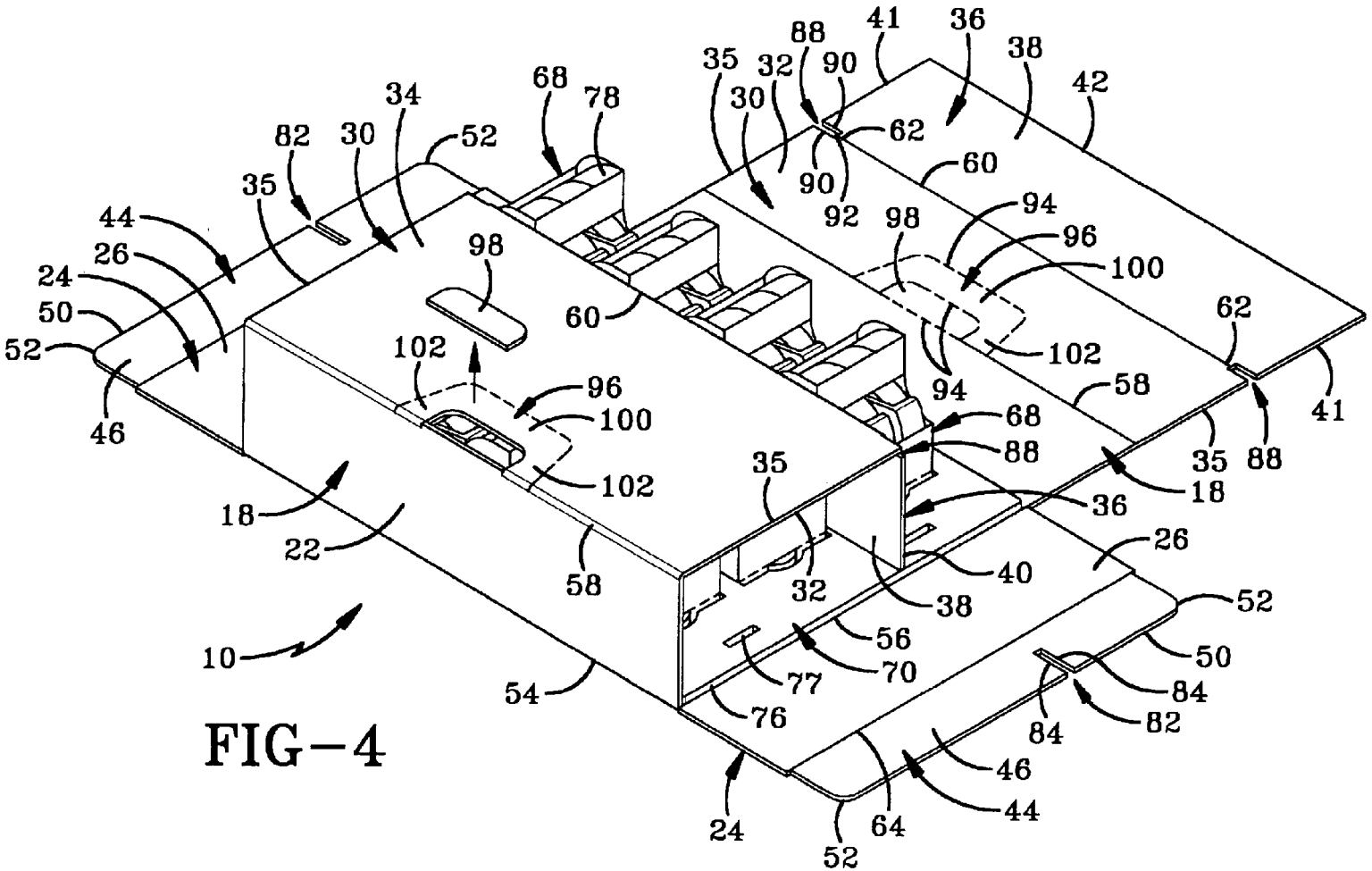
FIG. 4 is a perspective view of the shipping box in a partially folded position about the display board and retail product and showing a cutout being removed.

FIG. 4 shows box 10 further folded inwardly along one fold line 58 and downwardly along one fold line 60, so that one top wall portion 30 is generally horizontal above a portion of display board 70 and retail products 68, and one top insert 36 is generally vertical between retail products 68 with one terminal edge 42 contacting upper surface 72 of display board 70. FIG. 4 also shows one cutout 98 removed from one top wall portion 30, facilitated by one slit 94 which defines cutout 98.

Figure 5:
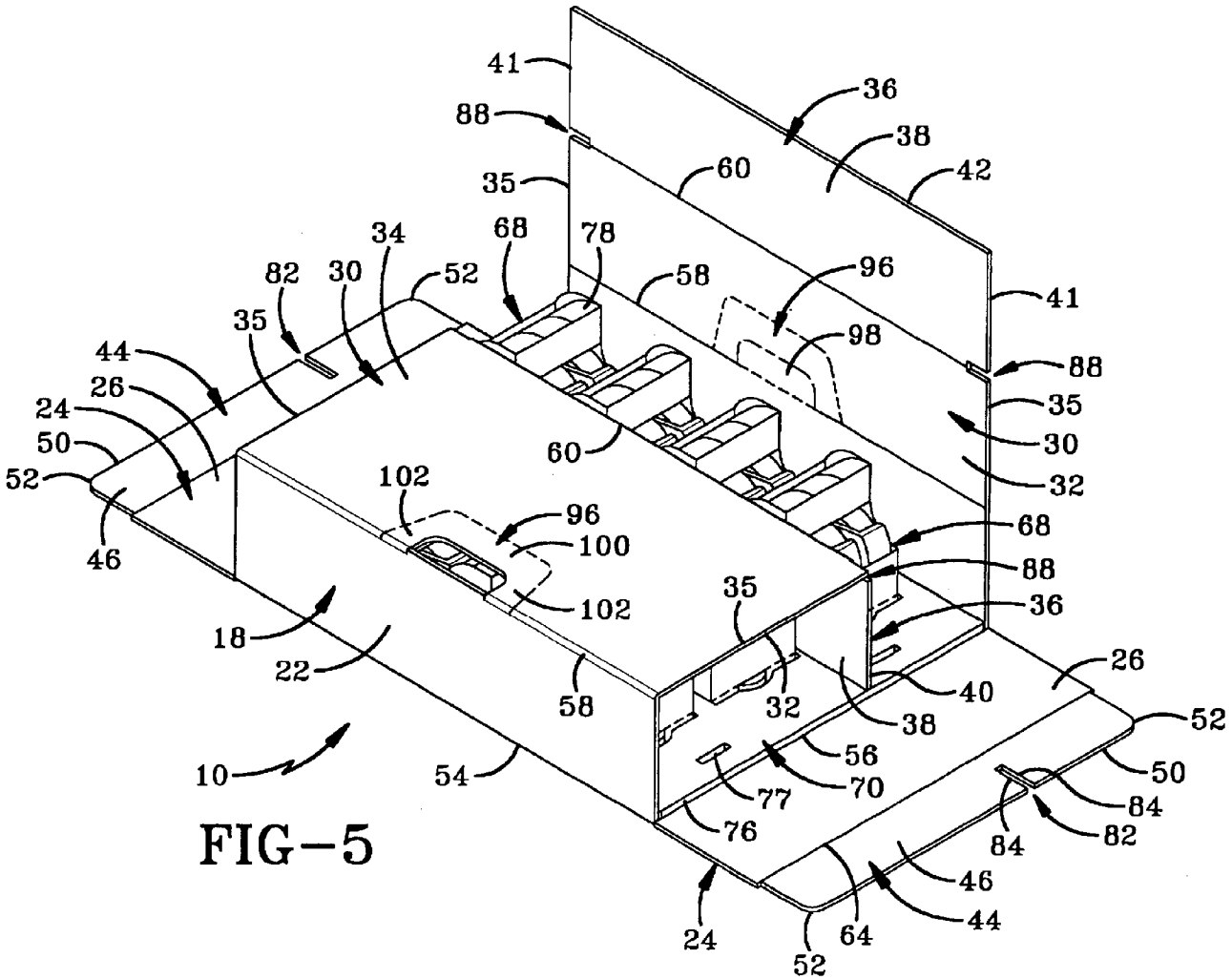
FIG. 5 is a perspective view of the shipping box in a partially folded position about the display board and retail product with the cutout removed.

FIG. 5 shows box 10 folded upwardly along fold line 54 so that side wall 18, top wall portion 30 and top insert 36 are aligned in a generally vertical plane, and inner surface 20 of side wall 18 contacts one edge 76 of display board 70.

Figure 6:
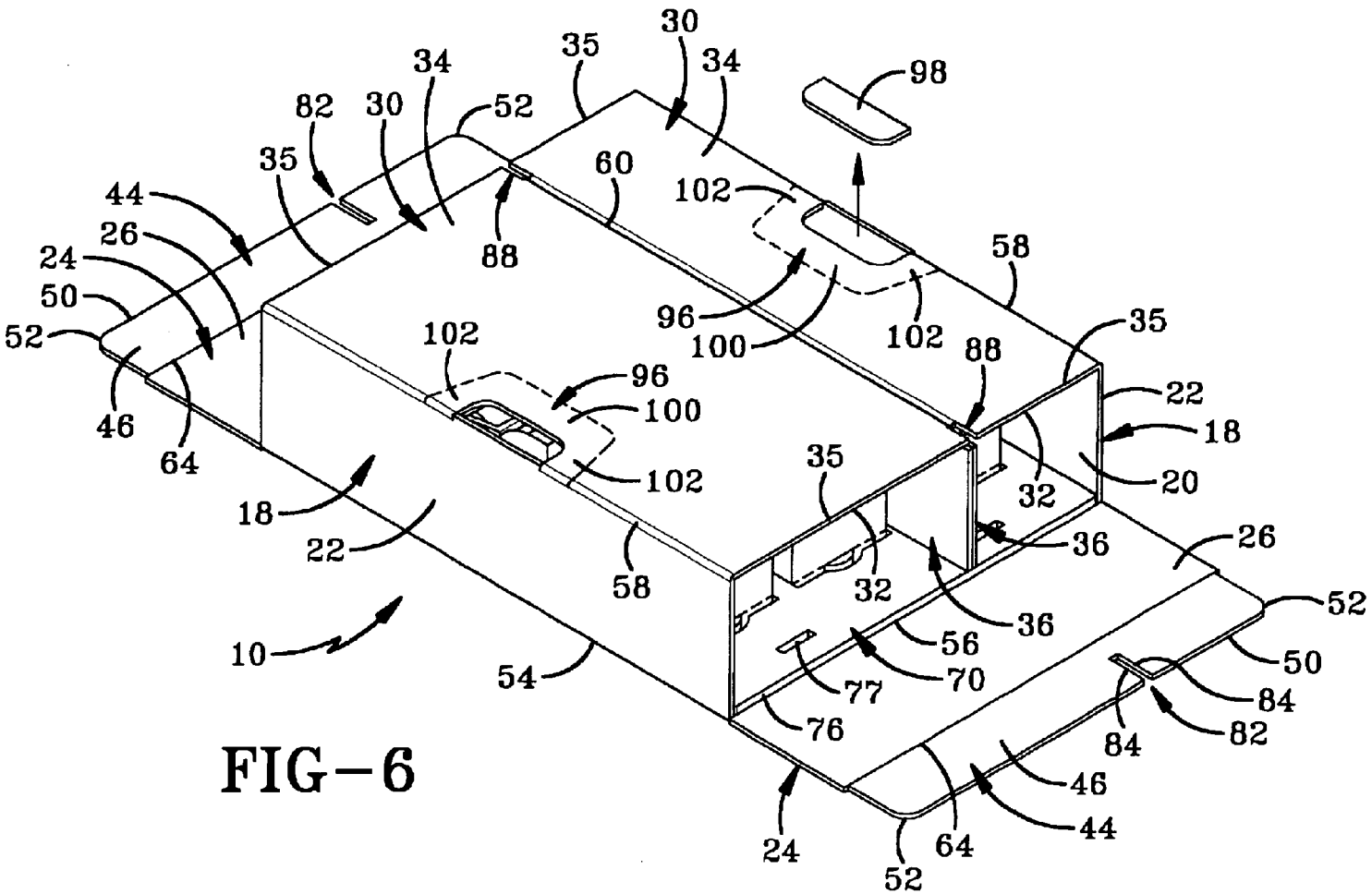
FIG. 6 is a perspective view of the shipping box in a partially folded position about the display board and retail product with one cutout removed and another cutout being removed.

FIG. 6 shows box 10 further folded inwardly along fold line 58 and downwardly along fold line 60, so that top wall portion 30 is generally horizontal above a portion of display board 70 and retail products 68, and top insert 36 is generally vertical between retail products 68 with one terminal edge 42 contacting upper surface 72 of display board 70. Top inserts 36 are in abutting alignment with each other when in the closed position of FIG. 6, with top wall portions 30 forming a top above the retail products 68 and display board 70. FIG. 6 also shows the other cutout 98 removed from the other top wall portion 30. The removal of cutouts 98 prevents their being pushed into box 10, which could damage retail products 68.

Figure 7:
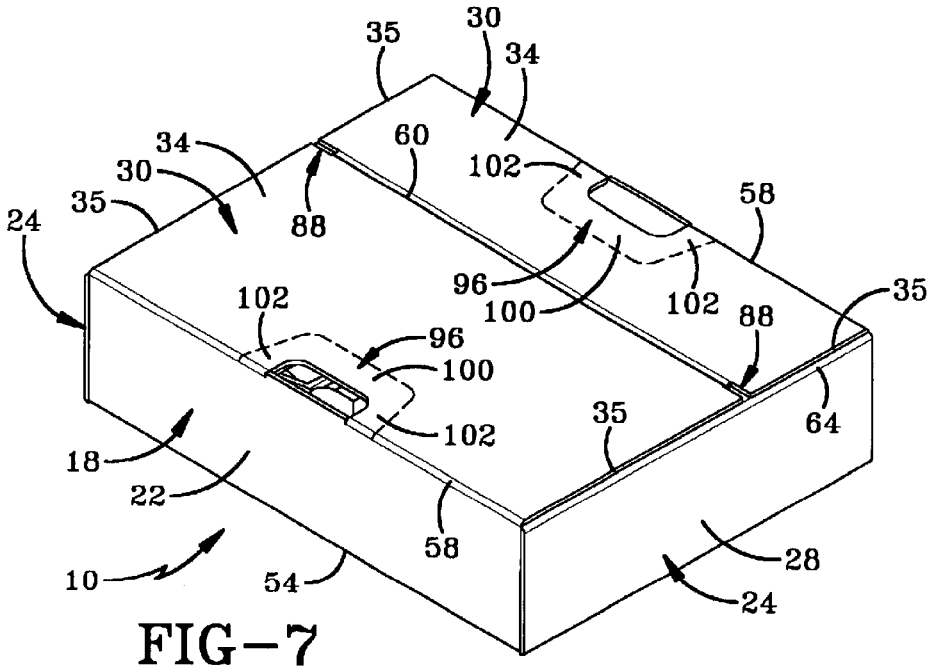
FIG. 7 is a perspective view of the shipping box in a fully folded position with both cutouts removed.

FIG. 7 shows box 10 in the folded configuration. End walls 24 have been folded upwardly along fold lines 56 and end inserts 44 have been folded inwardly along fold lines 64 so that inner surfaces 26 of end walls 24 contact edges 76 of display board 70. End inserts 44 slide into opposite ends of storage chamber 66. The folded configuration of end inserts 44 and the meshing of slots 82 and 88 are described above and shown in FIGS. 10–12.

Figure 8:
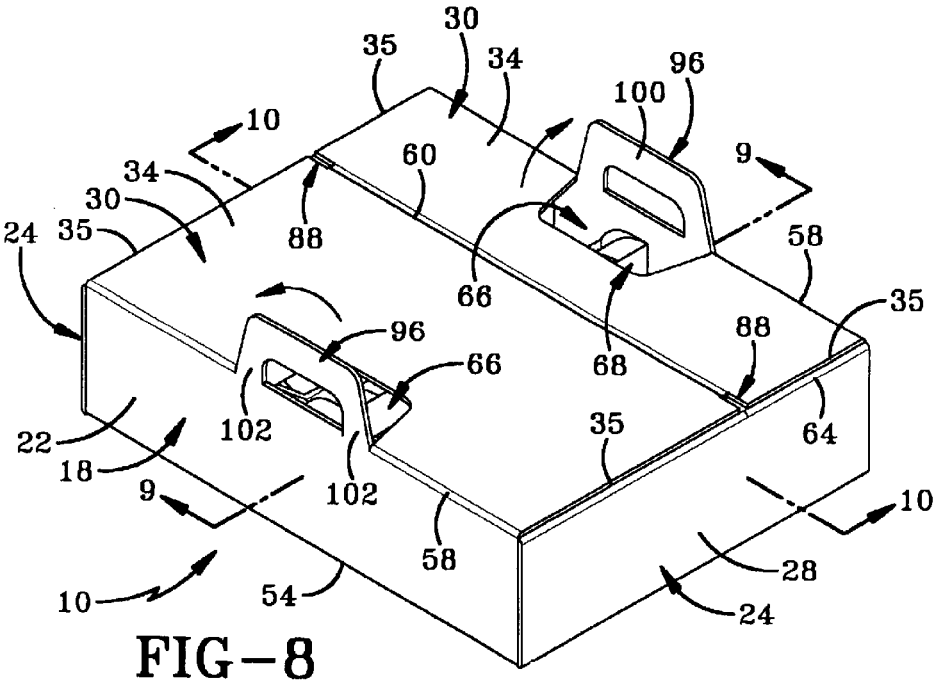
FIG. 8 is a perspective view of the shipping box in a fully folded position with two handles extending therefrom.

FIG. 8 shows box 10 in the folded configuration with U-shaped handles 96 folded upward along fold lines 58, ready to be lifted and placed in shipping container 106 (FIG. 13).

It will be appreciated that some of the folding along separate fold lines can be done simultaneously, or partially in a different order than that described herein. Likewise, the removal of cutouts 98 could be done in a different order. However, side walls 18, top wall portions 30 and top inserts 36 should be folded into their final positions before end inserts 44 are folded and slid into place.

Accordingly, the improved shipping box for retail products is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding, but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved shipping box for retail products is constructed and used, the characteristics of the construction, and the advantageous, new and useful results obtained; the new and useful structures, devices, elements, arrangements, parts and combinations are set forth in the appended claims.

What is claimed is:

1. In combination, a display board with retail products attached thereto in rows and a shipping box for containing the board and products, the shipping box comprising:

a bottom wall;

a pair of opposing side walls extending from the bottom wall;

a pair of top wall portions, each extending from a respective one of the side walls;

a pair of top inserts, each extending from a respective one of the top wall portions;

a pair of opposing end walls extending from the bottom wall;

a pair of end inserts, each extending from a respective one of the end walls;

the side walls, end walls, top wall portions, top inserts and end inserts, when folded inwardly, and the top inserts when inserted to extend toward the bottom wall between adjacent rows of the products, forming a plurality of interior storage chambers therebetween containing the display board and products therein.

2. The combination as defined in claim 1 in which the display board has edges and the side and end walls have inner surfaces contacting the edges of the display board when the box is in the folded configuration.

3. The combination as defined in claim 1 in which the display board has a lower surface and the bottom wall has an inner surface adapted to contact the lower surface of the display board.

4. The combination as defined in claim 1 in which the retail products are tape dispensers.

5. The combination as defined in claim 1 in which the display board has an upper surface and the top inserts have terminal edges contacting the upper surface of the display board to define a space between the top wall portions and the retail products when the box is in the folded configuration.

6. The combination as defined in claim 1 in which each end insert has an edge and a slot formed therein extending from said edge partially across the end insert.

7. The combination as defined in claim 6 in which the top wall portions have edges and the top inserts have side edges; and in which four slots are formed in the box so that each of the four slots is formed partially in one top wall portion and partially in the adjacent top insert and extends partially across the box from the edges of the top wall portions and side edges of the top inserts.

8. The combination as defined in claim 7 in which a first pair of the four slots lies adjacent one another and a second pair of the four slots lie adjacent one another when the box is in a folded configuration.

9. The combination as defined in claim 8 in which each slot formed in the end inserts meshes with one pair of the adjacent slots.

10. The combination as defined in claim 1 in which slits are formed in at least one of the top wall portions and define an outwardly foldable handle.

11. The combination of claim 1 wherein the display board has edges and the side walls have respective inner surfaces and end walls have respective inner surfaces; and wherein at least one of (1) the inner surfaces of the side walls and (2) the inner surfaces of the end walls contact the edges of the display board when the box is in the folded configuration.

12. A method of assembling a shipping box with a display board having a plurality of retail products attached thereto in rows, comprising the steps of:

providing an unfolded shipping box comprising a bottom wall, a pair of opposing side walls extending from the bottom wall, a top wall portion extending from each side wall, a top insert extending from each top wall portion, a pair of opposing end walls extending from the bottom wall, an end insert extending from each end wall;

placing the display board on the inner surface of the bottom wall;

folding the side walls upwardly;

folding the top wall portions inwardly;

folding the top inserts downwardly;

inserting the top inserts toward the bottom wall between the rows of products;

folding the end walls upwardly;

folding the end inserts inwardly;

inserting the end inserts adjacent the top wall portions; and thereby forming a plurality of interior storage chambers therebetween to contain the display board and retail products.

13. The method of claim 12 in which the display board has an upper surface; and the method of assembly further comprising the step of inserting the top inserts into the box so that the top inserts contact the upper surface of the display board to space the top wall portions from the products.

14. The method of claim 12 in which each end insert has an edge and a slot formed therein extending from said edge partially across the end insert; the top wall portions have edges and the top inserts have side edges, and in which four slots are formed in the box so that each of the four slots is formed partially in one top wall portion and partially in the adjacent top insert and extends partially across the box from the edges of the top wall portions and side edges of the top inserts; in which a first pair of the four slots lies adjacent one another and a second pair of the four slots lie adjacent one another when the box is in a folded configuration; and the method of assembly further including the step of:

meshing each slot formed in the end inserts with one pair of the adjacent slots.

15. The method of claim 12 wherein the step of folding the side walls upwardly includes the step of contacting edges of the display board with respective inner surfaces of the side walls.

16. The method of claim 12 wherein the step of folding the end walls upwardly includes the step of contacting edges of the display board with respective inner surfaces of the end walls.

17. In combination, a display board with products attached thereto and a shipping box for containing the display board and products, the shipping box comprising:

a bottom wall;

a pair of opposing side walls extending from the bottom wall;

a pair of top wall portions each extending from a respective one of the side walls;

a pair of top inserts each extending from a respective one of the top wall portions;

a pair of opposing end walls extending from the bottom wall;

a pair of end inserts each extending from a respective one of the end walls;

the side walls, end walls, top wall portions, top inserts and end inserts, when folded inwardly, and the top inserts when inserted to extend toward the bottom wall, forming a plurality of interior storage chambers therebetween containing the display board and products therein.

18. The combination of claim 17 wherein the display board has an upper surface and the top inserts have terminal edges contacting the upper surface of the display board to define a space between the top wall portions and the products when the box is in a folded configuration.

19. The combination as defined in claim 17 in which the display board has a lower surface and the bottom wall has an inner surface adapted to contact the lower surface of the display board.

20. The combination of claim 17 wherein the display board has edges and the side walls have respective inner surfaces and end walls have respective inner surfaces; and wherein at least one of (1) the inner surfaces of the side walls and (2) the inner surfaces of the end walls contact the edges of the display board when the box is in the folded configuration.

21.The combination of claim 17 wherein slits are formed in at least one of the top wall portions to define an outwardly foldable handle.

22. The combination as defined in claim 17 in which the bottom wall, side walls, top wall portions, top inserts, end walls and end inserts are formed integrally with one another to form a one-piece member.

23. The combination as defined in claim 17 in which the top inserts lie adjacent one another when the box is in the folded configuration.

24. The combination as defined in claim 17 in which each end insert has an edge and a slot formed therein extending from said edge partially across the end insert.

25. The combination as defined in claim 24 in which the top wall portions have edges and the top inserts have side edges; and in which four slots are formed in the box so that each of the four slots is formed partially in one top wall portion and partially in the adjacent top insert and extends partially across the box from the edges of the top wall portions and side edges of the top inserts.

26. The combination as defined in claim 25 in which a first pair of the four slots lies adjacent one another and a second pair of the four slots lie adjacent one another when the box is in a folded configuration.

27. The combination as defined in claim 26 in which each slot formed in the end inserts meshes with one pair of the adjacent slots.

28. The combination as defined in claim 21 in which the slits are formed in each of the top wall portions to define a pair of outwardly foldable handles; each handle being outwardly foldable from adjacent the fold line between a respective side wall and the top wall portion extending therefrom.

29. The box of claim 25 wherein each of the four slots has elongated parallel edges which are adjacent and substantially parallel to the fold line between the respective top wall portion and top insert so that each of the four slots is elongated in a direction substantially parallel to said fold lines.

30. The shipping box as defined in claim 29 in which the top inserts have terminal edges adapted to contact the display board and the top inserts are dimensioned to space the top wall portions from the retail products when the box is in the folded configuration.

* * * * *